United States Patent [19]

Gerlier

[11] Patent Number: 4,993,556

[45] Date of Patent: Feb. 19, 1991

[54] TURNING DEVICE FOR SHEET-LIKE ITEMS AND PROCESS FOR ITS OPERATION

[75] Inventor: Andr',acu/e/ Gerlier, Sciez, France

[73] Assignee: Landis & Gyr Betriebs AG, Zug, Switzerland

[21] Appl. No.: 443,927

[22] Filed: Nov. 30, 1989

[30] Foreign Application Priority Data

Jan. 9, 1989 [CH] Switzerland ..... 00057/89

[51] Int. Cl.[5] ..... B07C 5/00; B65H 29/00

[52] U.S. Cl. ..... 209/534; 209/540; 271/185; 271/186

[58] Field of Search ..... 271/225, 184, 185, 186, 271/902, 187; 209/534, 540, 545; 198/394, 395, 412, 404; 221/157, 158, 171, 173

[56] References Cited

U.S. PATENT DOCUMENTS

| | | | |
|---|---|---|---|
| 4,319,137 | 3/1982 | Nakamura et al. | 250/556 |
| 4,602,775 | 7/1986 | Calhoun et al. | 271/186 X |
| 4,871,163 | 10/1989 | Landa et al. | 271/902 X |

FOREIGN PATENT DOCUMENTS

| | | | |
|---|---|---|---|
| 3544880 | 6/1986 | Fed. Rep. of Germany . | |
| 3812005 | 10/1988 | Fed. Rep. of Germany . | |
| 57131262 | 2/1984 | Japan . | |
| 661603 | 7/1987 | Switzerland . | |
| 1406251 | 9/1975 | United Kingdom | 271/186 |

*Primary Examiner*—H. Grant Skaggs
*Assistant Examiner*—Cheryl L. Gastineau
*Attorney, Agent, or Firm*—Marmorek, Guttman & Rubenstein

[57] ABSTRACT

A turning device which receives randomly oriented sheet-like items, such as bank notes, and delivers them in a predetermined orientation comprises a testing station which determines the initial orientation of the items, a control device which receives signals emitted by the testing station indicative of the initial orientation, and a conveying system which is responsive to the control device for re-orienting the items. The turning device includes a service station having a conveying path therein. The service station is rotatable about an axis of rotation into first and second rest positions which are separated by 180° by arc. The conveying path of the service station is operable in forward and reverse directions. The conveying path of the service station also includes two openings through which it receives the items and discharges them after they have been reoriented. Depending on the initial orientation of the items, the control device delivers the items to the conveying path of the service station through one of the two openings, instructs the conveying path whether to rotate about its axis, and instructs the conveying path whether to continue operating in the forward direction or to reverse directions. Thereby, the control device enables the turning device to receive randomly oriented items through an input and to deliver them to an output according to a predetermined orientation. A sorting mechanism can be connected to the output of the turning device so that the sheet-like items can be stacked in separate compartments according to the predetermined orientation.

16 Claims, 3 Drawing Sheets

TURNING DEVICE FOR SHEET-LIKE ITEMS AND PROCESS FOR ITS OPERATION

BACKGROUND OF THE INVENTION

The instant invention relates to a turning device which aligns randomly oriented sheets into a prescribed manner.

Such turning devices are used to advantage in banknote sorting installations.

Sheet-shaped items such as banknotes, documents or imprinted pages in general are sheet- or leaf-like with a front and back side, and are capable of being oriented, with at least one side being imprinted with a predetermined pattern. These sheet-like items are presented in stacks in manual or also in the newer, automatic receiving stations for banknotes, these stacks being sorted with respect to their exterior or overall configuration but being unsorted with respect to the pattern. Banking institutions on the other hand store the banknotes in bundles, desirably with a preselected orientation of the pattern.

The German patent document DE-OS 35 44 880 A1 describes a device which guides banknotes and similar items through a conveying system without regard to orientation at the input in such manner that it delivers all banknotes with the backside down for example. The conveying system is provided with a conveying path which can be switched over only in the running direction.

U.S. Pat. No. 4,319,137 discloses a testing station which ascertains the authenticity and the orientation of an imprinted, sheet-like item that is oriented in the reading plane of the testing station only according to its outer configuration and is conveyed by means of endless belts. The items judged to be authentic must show patterns from a predetermined set.

German patent document DE-OS 38 12 005 A1 furthermore discloses a sorting device in which sheet-like items are deposited in predetermined stacking compartments.

A design for a conveyor system with endless belts can also be derived from Swiss patent 661,603 for example.

It is the object of the instant invention to provide a turning device which accepts randomly oriented sheet-like items from an input device, which turns them rapidly and without damaging them into a predetermined position or orientation and which transmits the items to a receiving device, as well to provide a process for operation of such a turning device.

SUMMARY OF THE INVENTION

In accordance with the present invention, a turning device for orienting sheet-like items, such as bank notes, is provided comprising an input for receiving the items, an output for discharging the items in a predetermined orientation, a conveying mechanism for transporting the items, and a service station rotatable about an axis of rotation into first and second rest positions separated by 180° of arc. The service station includes a first conveyor path terminating in first and second openings through which the service station receives and discharges the items, and a reversible drive mechanism for driving the items on the first conveyor path either in a forward or a reverse direction. The inventive turning device further comprises a second conveyor path for transporting the items from the input to one of the two openings in the service station, a third conveyor path receiving the items discharged from the service station and delivering them to the output, and control means for controlling the rotation of the service station and the direction of movement of the items along the first conveyor path in the service station so that items delivered to the service station in a random orientation are reoriented and delivered to the output in a predetermined orientation.

In an embodiment, the turning device further includes testing means connected to the control means for determining the initial orientation of the items and a switching station disposed along the second conveying path. The second conveyor path includes first and second bifurcations terminating at positions located in registration with the first and second openings of the service station. The switching station, under the control of the control means, directs the items to one of the two bifurcations so that the items are delivered to the first or second opening of the service station, depending on their initial orientation. In the embodiment, the third conveyor path comprises first and second arms connected to the first and second bifurcations, the first and second arms receiving the items from the bifurcations after they have been reoriented and discharged by the service station, and delivering the items to the output through a combining inlet.

BRIEF DESCRIPTION OF THE DRAWINGS

Embodiments of the invention are explained in greater detail below through the drawings in which.

DETAILED DESCRIPTION OF THE INVENTION

Figure 1:
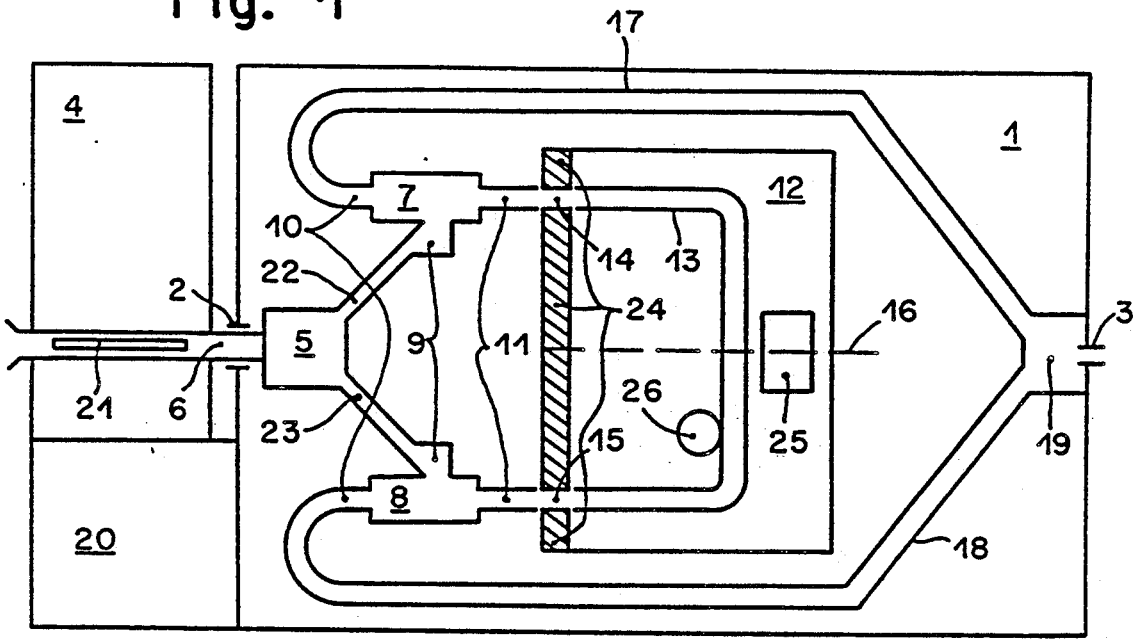
FIG. 1 shows a section through a turning device of the instant invention for sheet-like items.

Referring to FIG. 1, an embodiment of the inventive turning device 1 is illustrated, wherein 2 is an input and 3 an output of the turning device 1, 4 is a testing station, 5 is a switching station, 6 is a belt conveyor, 7 and 8 are first and second bifurcations, 9 and 10 are first and second branches and 11 a trunk of the bifurcations 7 and 8, 12 is a service station with a conveying path 13 having openings 14 and 15, and 16 is a rotational axis for the out-of-plane rotation of the service station 12.

A conveyor system in turning device 1 consists of a first arm 17 and a second arm 18 as well as of an inlet 19 where the two arms 17 and 18 are brought together and lead jointly into output 3.

The necessary electrical connections between the switching station 5, the belt conveyor 6, the service station 12, the conveying path 13 and the parts 17 to 19 of the conveyor system, and a control device 20 are not shown for the sake of clarity in the drawing.

A transport system leading to the turning device 1 could consist of an arrangement of endless belts, rollers, electric motors and guiding plates, for example, as well as of additional elements known in the conveying technology. In the drawings all the rolls rotate around axes which are perpendicular to the plane of the drawing.

Such belts, rollers and guiding plates also constitute the belt conveyor 6, the switching station 5, the bifurcations 7 and 8, the conveying path 13 and the conveyor system consisting of the parts 17 to 19. They convey sheet-like items 21 which are clampingly held between belts running parallel to each other from the input 2 via service station 12 to the output 3, whereby the control device 20 selects one of the preselected paths for the items 21 through the turning station 1 as a function of the orientation of the items 21 ascertained by the testing station 4.

The control device 20 and the testing station 4 are devices with which the turning device 1 is equipped and which are shown in FIG. 1 only in order for the operation of the turning device 1 to become more easily understandable.

The switching station 5 is provided with a drive mechanism under the control of the control device 20, e.g., an electric motor, an electric pulling magnet, etc., which directs the path of the items 21 from input 2 to one of the two openings 14 or 15.

The belt conveyor 6 extends from the input 2 to the switching station 5 and divides there into the branches 22 and 23. Each branch 22 or 23 leads over a first branch 9 of the bifurcation 7 or 8 into the trunk 11. From a second branch 10 of the bifurcation 7 or 8, an arm 17 or 18 of the conveyor system leads to one of the two entrances of the inlet 19 which lets out in the output 3.

The service station 12 is drawn in FIG. 1 in one of the two rest positions. In the service station 12, the conveying path 13 is symmetrical with respect to the rotational axis 16, being for example U-shaped in the segment shown. The two openings 14 and 15 of the conveying path 13 are positioned on a wall 24 of the service station 12. The wall 24 is perpendicular to the rotational axis 16 and separates the conveying path 13 from the two trunks 11 of the bifurcations 7 and 8. When the service station 12 is rotated around the rotational axis 16 from one into the other rest position, the two openings 14 and 15 therefore merely exchange positions in relation to the trunks 11 of the bifurcations 7 and 8. The motor drive required for this rotation is not shown.

The conveying path 13 is equipped with a sensor 25 which detects the presence of the items 21 optically or mechanically, for example. The sensor 25 is connected over a signal circuit to the control device 20 and transmits this presence to the latter by means of an electrical signal. The sensor 25 can be installed for instance at a midway location along the length of the conveying path 13, with the length of the conveying path 13 being approximately two to three times the length of the longest items 21 expected in the conveying direction.

The conveying path 13 is equipped with a drive 26 which is reversible with respect to its moving direction. The control device 20 is connected electrically via circuits to the drive 26, switches said drive 26 on or off, and determines its moving direction. Thus the conveying path 13 is able to convey the items 21 in the direction going from the opening 14 to the opening 15 as well as in the opposite direction or to stop the items 21 as soon as the sensor 25 detects the presence of said items 21.

Each trunk 11 is aligned in one of the two rest positions of the service station 12 with one of the two openings 14 or 15 of the conveying path 13 in such manner that the items 21 are able to change over in both rest positions of the service station 12 from each trunk 11 into the conveying path 13 and vice-versa.

The bifurcations 7 and 8 are designed so that items 21 coming from the first branch 9 are guided into the trunk 11 and from there through the openings 14 or 15 into the conveying path 13. Conversely, the items 21 coming into the bifurcation 7 or 8 from the openings 14 or 15 leave said bifurcation 7 or 8 always via its second branch 10 and are received by arm 17 or 18 of the conveyor system.

The belt conveyor 6 conveys the sheet-like items 21 in a flat state from the reading plane of the testing station 4 through the input 2 to the switching station 5. While the items 21 pass through, the testing station 4 recognizes through optical or mechanical scanning mechanisms for example the pattern of the sheet-like items 21 on one or both sides of same and compares at least one pattern against a set of preselected patterns stored in the testing station 4. The testing station 4 ascertains the orientation of the items 21 in said testing station 4 and transmits an orientation signal corresponding to one of the four possible position states to the control device 20. If the scanned pattern is not contained in the preselected set, an error signal instead of the orientation signal is transmitted to the control device 20 as this item 21 does not meet the requirements set down in the preselected set of patterns and must be separated as being a non-identified item, e.g., as a blank or damaged sheet, a sheet with foreign or counterfeit printing, etc.

In another embodiment, the testing station 4 measures the dimensions of the items 4 as additional parameters and transmits these testing results also to the control device 20.

It is also conceivable that the items 21 may have an easily recognized exterior configuration which is sufficient for orientation, such as for example the well-known punched card with one corner cut off. In that case the testing station 4 must only ascertain the form in order to obtain a sufficient signal enabling it to determine the orientation.

The control device 20 processes the signals of the testing device 4 and directs the switching station 5 into the correct position by means of a command signal in order for the belt conveyor 6 to convey the items 21 from the input 2 through switching station 5 and through one of the branches 22 or 23 into the first branch 9 of the bifurcation 7 or 8. As soon as the item 21 has passed through the trunk 11 and extends into the opening 14 or 15, the conveying path 13 takes over the item 21 and conveys it to the sensor 25. When the item arrives at the sensor 25, said sensor 25 transmits a presence-signal to the control device 20. The control device 20 selects the subsequent path of the items 21 through the turning device 1 as a function of the orientation or error signal.

The item 21 is in one of four possible positions at the input 2. For example, if the item 21 is conveyed from left to right through the input 2 in the sense of its greatest dimension, the testing device 4 has already classified the orientation of the item 21 under one of the four position states or under an error state.

State 1: The item 21 is presented with its face on the right side,

State 2: The item 21 is presented with its face on the wrong side,

State 3: The item 21 is presented with its verso on the right side,

State 4: The item 21 is presented with its verso on the wrong side,

State 5 The item 21 cannot be identified (Error state).

If item 21 is imprinted on one side only, both sides of said item 21 must be checked for clear identification.

The control device 20 activates the elements 5, 12 and 13 of the turning device as a function of one of the four states so that the item 21 may be delivered at the output 3 with a predetermined orientation, and this independently of its position at the input 2. In the following example the state 1 is determined to be the preselected orientation.

The item 21 in state 1 or 5 is guided by the control device 20 by means of the switching station 5 via a bifurcation 7 or 8 into the conveying path 13 and leaves the service station 12 without stopping via the other bifurcation 8 or 7.

The item 21 in state 2 is guided by the control device 20 by means of the switching station 5 via one bifurcation 7 or 8 into the conveying path 13 to the sensor 25 and is stopped there. The service station 12 then rotates in one step of 180° around the rotational axis 16. The item 21 halts in the conveying path 13 until the service station 12 has assumed the other rest position. The item 21 then leaves the service station 12 via the other bifurcation 8 or 7.

The item 21 in state 3 or 4 is guided by the control device 20 by means of switching station 5 via the bifurcation 7 or 8 in the conveying path 13 to the sensor 25 and is stopped there. Only when the item is in the state 3 does the service station 12 rotate in a step of 180° around the rotational axis 16. The item 21 halts in the conveying path 13 until the service station 12 has assumed the other rest position. This rotation is omitted for an item 21 in state 4. The direction of movement of the drive 26 is then reversed and the item 21 leaves the service station 12 via the same bifurcation 7 or 8 through which it entered.

In order to deposit the items 21 in a predetermined manner, two different paths going to the output 3 are open for each of the states of items 21, with each of the two paths being attributed one direction of movement of the conveying path 13. The direction of movement of the conveying path 13 which was needed for the preceding item 21 to leave the service station 12 is therefore advantageously maintained to receive the next item 21. The operating rate of the turning device 1 is therefore raised considerably if the control device 20 also takes into account the direction of movement of the conveying path 13 to set the switching station 5. The time-consuming reversal of the direction of movement of the conveying path 13 is thus avoided as much as possible.

The conveyor system consisting of elements 17 to 19 conveys the items 21 to the output 3.

Non-identified items are advantageously sorted out as early as before, or in the switching station 5 to avoid encumbering the turning device 1. Switching station 5 can for instance be made in the form of a three-way switch which ejects the non-identified items into a container via a third path which is not shown here.

Additional sensors connected to the control device 20 are also not shown. The control device 20 controls the progression of the items 21 through the turning device 1 by means of these sensors.

One of these sensors is advantageously provided in each trunk 11. As soon as the forward edge of the item 21 reaches the sensor as it is conveyed in the direction of the service station 12, the control device 20 switches on the drive 26 while the selected direction of movement of the conveying path 13 is that of the conveying direction of the item 21.

Figure 2:
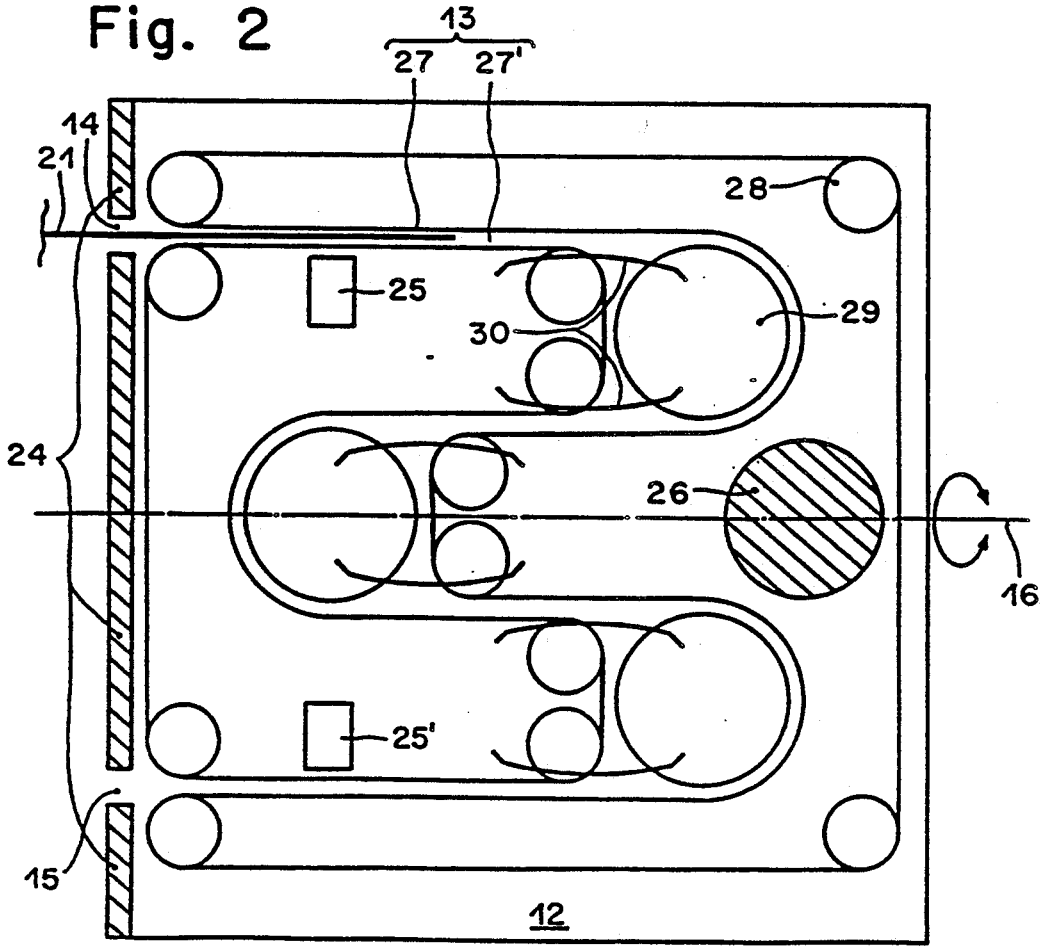
FIG. 2 shows a section through a service station which forms a part of the inventive turning device.

FIG. 2 shows an embodiment of the service station 12. In order to allow for compact construction, this embodiment is provided with a W-shaped conveying path 13 and with two sensors 25 and 25'. Both sensors 25 and 25' are connected to the control device 20 and transmit a presence signal if the item 21 is present beneath one of the sensors 25, 25'. The control device 20 interrupts the running of drive 26 in this embodiment only once the two sensors 25 and 25' have signaled the presence of the same item 21.

At least one pair of partially parallel, endless belts 27, 27' defining one plane constitute conveying path 13. Each pair consists of an outer belt 27 and an inner belt 27'. Each belt 27, 27' is guided over deflection rollers 28 on the side away from item 21. The belts 27, 27' are advantageously suitable toothed conveyor belts, with at least one of the deflection rollers 28 being made in the form of a toothed wheel which engages the toothed belt. The side of both belts 27 and 27' towards the item 21 is smooth and is covered with a material with high adhesive frictional properties such as rubber. To reverse the conveying path 13 this smooth side alone is guided over polished cylinders 29. When the belt 27 or 27' is guided over the cylinder 29, guiding rails 30 which are arranged in pairs prevent the items 21 from winding around the cylinder 29.

In the drawing the deflection rollers 28 have a smaller diameter than the cylinders 29 and only one element of either kind is given the reference numbers 28 or 29 for the sake of clarity. For the same reason only one of the three pairs of guiding rails 30 is designated with its reference number.

The item 21 goes through one of the two openings 14 or 15 in the wall 24 and into the service station 12, is seized by the two belts 27, 27' and is conveyed between these in a non-damaging manner to the second sensor 25∝ or 25.

The drive 26 drives advantageously each belt 27, 27' by means of endless belts (not shown here) via at least one deflection roller 28, whereby the utilization of toothed belts makes it possible to impart high acceleration or deceleration to the items 21.

The direction of rotation of the service station 12 around the rotating axis 16 is changed advantageously between the turning operations so that the signal circuit (not shown) of the drive 26 and the sensors 25, 25' does not wind around the rotational axis 16, and so that it does not become necessary to use an expensive arrangement with failure-prone sliding contact rings instead of inexpensive circuits.

Figure 3:
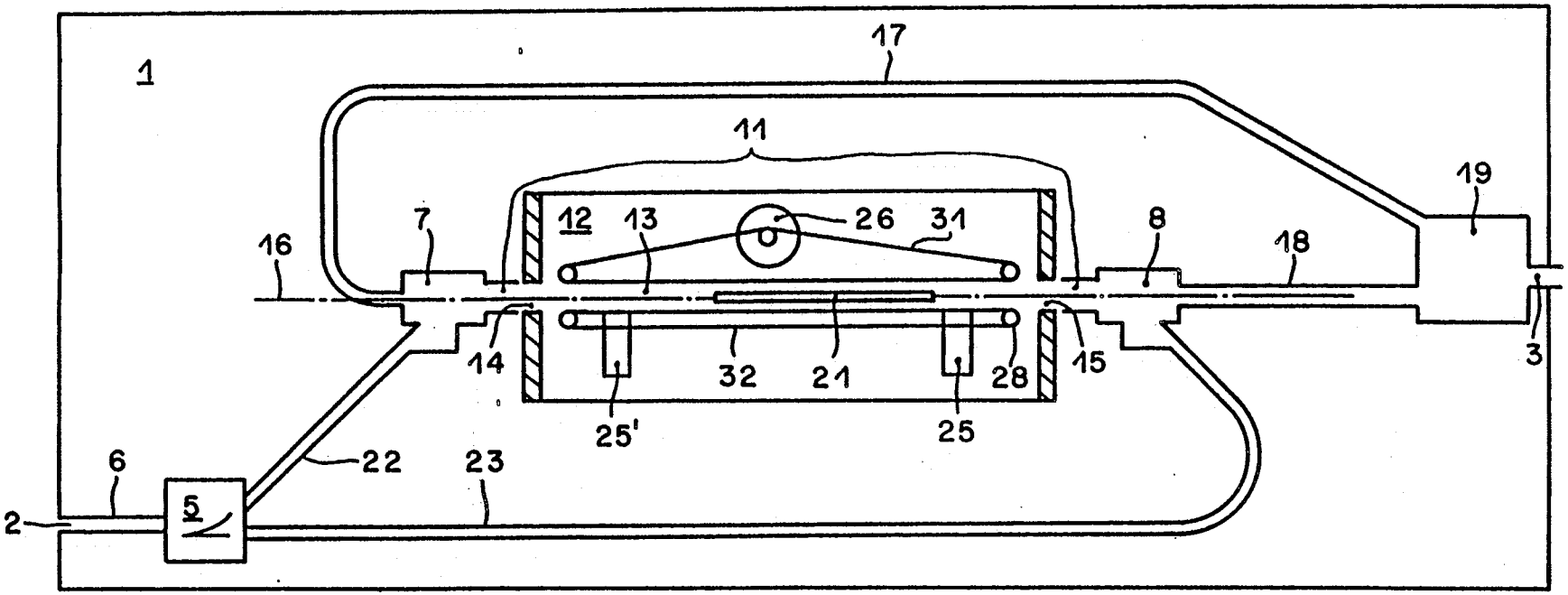
FIG. 3 shows a section through a second embodiment of the inventive turning device.

FIG. 3 shows a second embodiment of the turning device 1 with lower structural height. In contrast to the embodiment according to FIG. 1, the service station 12 is placed between the trunk 11 of the two bifurcations 7, 8. The conveying path 13 is straightened, requires no cylinder 29 (FIG. 2) and fewer deflection rollers 28 (FIG. 3). It contains the rotational axis 16 as its longitudinal symmetry axis. The planes of the openings 14, 15 at the two ends of the conveying path 13 are perpendicular to the rotational axis 16 which pierces the openings 14, 15 at the center of gravity.

In the drawing, the service station 12 is shown in one of the two rest positions with the plane of the conveying path 13 perpendicular to the plane of the drawing in each rest position. A rotation of 180° does not cause the outlets 14 and 15 to exchange positions because they rotate on the spot around the rotational axis 16. In contrast to the embodiment according to FIG. 1, the transition of the items 21 takes place in both directions in FIG. 3, always between the bifurcation 7 or 8 and the outlet 14 or 15.

A drive belt 31 and a running belt 32 constitute a pair for the conveying of the items 21. They are in contact with each other along the conveying path 13 which is equipped with at least one such pair. A pinion of drive 26 engages, directly for example, the teeth of the drive belt 31 which is made in the form of an endless toothed belt. The running belt 32 is driven by friction via drive belt 31. This arrangement of the conveying path 13 has a low moment of inertia.

The service station 12 has small masses at short distances from the rotational axis 16. The service station 12 therefore also has a low moment of inertia with respect to the rotational axis 16, i.e., a rotation from one rest position into the other meets with little resistance. The motor drive required for this rotation is not shown.

The advantages of this embodiment are a rapid change of running direction of the conveying path 13 and a rapid switching of the two rest positions of the service station 12, with favorable effect on the throughput amount of the items 21 to be oriented. Furthermore the two surfaces of the belts 31 and 32 which face the items 21 are in contact only with each other or with the items 21.

The belt conveyor 6 conveys the items 21 from input 2 via switching station 5 over one of its branches 22 or 23 to the opening 14 or 15. The conveying path 13 receives the items 21 through one of the openings 14 or 15 and conveys them to the sensor 25 or 25'. The items 21 are delivered in the preselected position through the output 3 from the turning device 1 by means of the conveying system consisting of the parts 17 to 19.

The control device 20 takes the different path lengths in the branches 22 and 23 as well as in the arms 17 and 18 into account with the help of the sensors alongside the conveying path which were mentioned earlier and are not shown here.

In a modified arrangement of the parts 5, 17, 18, 19, 22 and 23 which a person skilled in the art can easily discern from the arrangement shown in FIG. 3, the arms 17 and 18 as well as the branches 22 and 23 are of equal length and are as short as possible. This embodiment of the turning device 1 has the advantage of simpler control and greater throughput of banknotes 2.

Figure 4:
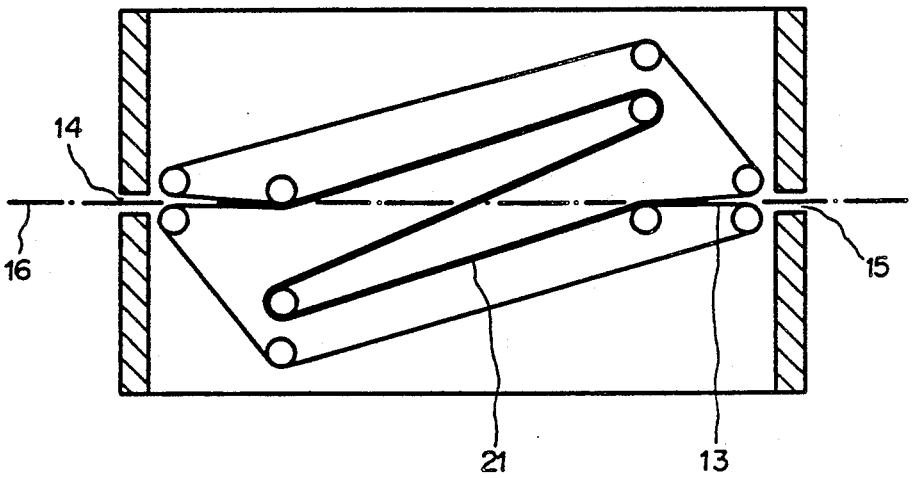
FIG. 4 shows a shortened service station of the inventive turning device shown in FIG. 3, and FIG. 5 shoWs a banknote sorting device with two inventive turning devices and with one downstream sorting device.

The service station 12 shown in FIG. 4 features an advantageous design of the conveying path 13 which is folded symmetrically in relation to the extension of the conveying path 13 to the rotational axis 16. Items 21 with longer dimensions in the conveying direction than the distance between the two openings 14, 15 can fit into the service station 12. The rotational axis 16 of the conveying path 13 is a longitudinal symmetry axis at least in the area of the openings 14, 15.

The drive 26 (FIG. 1) for the conveying path 13 is needed only in the two rest positions of the service station 12. The moment of inertia of the service station 12 is therefore advantageously lower in all embodiments if the drive 26 is built in rigidly in the turning device 1 and is connected to the conveying path 13 by means of a coupling only in the two rest positions of the service station 12. Furthermore the lead-ins to drive 26 can be omitted.

Using light barriers as the sensors 25, 25' the lead-ins going to the sensors of the service station 12 can also be omitted. One transmitter and one light receiver for each sensor 25 or 25' is built in rigidly in the turning device 1. In this embodiment passive reflectors which reflect the light ray from the transmitter to the light receiver are used in the service station 12 at the location of the sensors 25, 25'. The items 21 are conveyed between the reflector and the light receiver and interrupt the light ray for as long as items 21 are in the light barrier.

Figure 5:
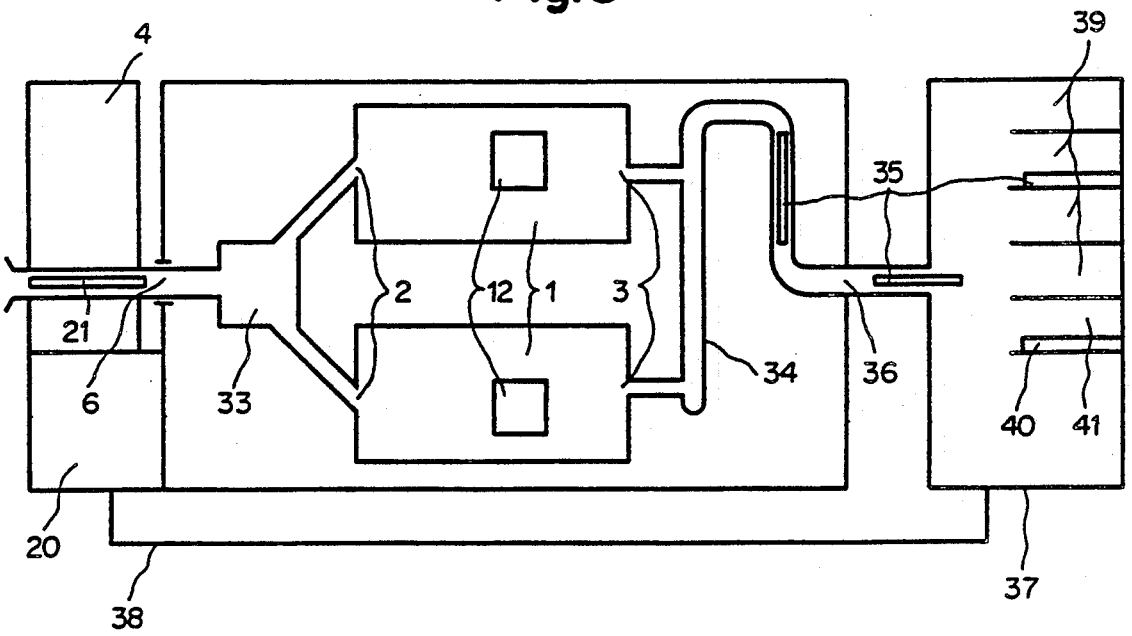

A banknote sorting device according to FIG. 5 is advantageously provided with at least two parallel turning devices 1 in order to increase the throughput of sheet-like items 21. The testing station 4 and the control device 20 are combined for operation of both turning devices. The belt conveyor 6 contains at least one bifurcation 33 which divides the path of the belt conveyor 6 to the input 2 of each turning device 1. The outputs 3 of each turning device 1 are also connected via a collecting belt 34 which conveys oriented items 35 to a delivery opening 36. As soon as one of the service stations 12 is empty the control device 20 determines the preselected running path by means of bifurcation 33 so that non-oriented items 21 may not be conveyed to one of the two turning devices the service station 12 of which is empty at the moment.

If sheet-like items 21 in different formats and/or with different patterns are fed in via the belt conveyors 6, the testing station 4 advantageously also transmits a pattern reference number to the control device 20. A sorting device 37 connected to the delivery opening 36 receives a positioning command corresponding to the pattern reference number from the control device 20 via a circuit 38 so that a path corresponding to the different formats or to the different patterns and going to a predetermined stacking compartment 39 may be opened to each oriented item 35 arriving at the delivery opening. Each item 35 is deposited in its assigned stacking compartments 39. In particular, items 40 which cannot be identified in the testing station 4 can be conveyed to a special "non-identified" stacking compartment 41.

Depending on the design, the belt conveyor 6, the conveying path 13, the service station 12 and the conveying system 17, 18 are provided with their own drive motors or are driven via controlled couplings by a common motor.

The utilization of electricity for control signals and for the drives is only indicated as an example. Instead of electrical signal circuits or electric drives, it is also possible to use pneumatic, optical or other signal circuits or pneumatic or hydraulic drives.

While the invention has been described by reference to specific examples, this was for purposes of illustration only and should not be construed to limit the spirit or the scope of the invention. Numerous alternative embodiments are also possible and are considered to be within the scope of the invention.

I claim:

1. A turning device with a conveying mechanism for orienting sheet-like items into a predetermined position, comprising a service station rotatable about an axis of rotation into first and second rest positions, said first and second rest positions being separated by 180° of arc, said service station including a conveying path having first and second openings, drive means for driving said items along said conveying path, and at least one sensing means for sensing the presence of said items upon said conveying path, a conveyor belt and a switching station along said conveyor belt, said conveyor belt receiving said items from an inlet and delivering them to said switching station, said conveyor belt further including first and second branches extending from said switching station, said switching station delivering said items to said first and second branches, first and second bifurcations connected to and receiving said items from said first and second branches of said conveyor belt respectively, said first and second bifurcations terminating at positions located opposite said first and second openings of said conveying path, said first and second bifurcations delivering said items to said service station through said first and second openings for reorientation, and receiving said items from said service station through said first and second openings after said items have been reoriented by said service station, a conveying system comprising first and second arms, a combining inlet, and an output, said first and second arms receiving said items from said first and second bifurcations after they have been reoriented and delivering said items to said output via said combining inlet, control means for controlling the direction of movement of said items along said conveying path of said service station, and signal circuit means connecting said switching station, said belt conveyor, said service station, said sensing means, said drive means, and said conveying system to said control means.

2. The turning device of claim 1, wherein said first and second openings of said conveying path are both located in a plane of said service station which is perpendicular to said axis of rotation, said conveying path and said first and second openings are disposed symmetrically about said axis of rotation, said first and second bifurcations include first and second trunks which terminate opposite said first and second openings, and said service station delivers said items from said first opening to said first trunk and from said second opening to said second trunk when said service station is in said first rest position, and said service station delivers said items from said first opening to said second trunk second and from said second opening to said first trunk when said service station is in said second rest position.

3. The turning device of claim 1, wherein said service station is disposed between said first and second bifurcations, said axis of rotation traverses said first and second openings and constitutes a longitudinal axis of symmetry for said conveying path at least in the area of said first and second openings, and said service station further comprises means for delivering said items from each of said openings to the same bifurcation when said service station is in both said first and second rest positions.

4. The turning device of claim 3 wherein said conveying path is substantially straight.

5. The turning device of claim 1 wherein said drive means comprises reversible drive means for driving said items along said conveying path along a forward or a rearward direction.

6. The turning device of claim 1 further comprising testing means connected to said control means for testing the initial orientation of said items, and for delivering a signal to said control means indicating said initial orientation.

7. In combination, the turning device of any one of claims 1 to 6, and a sorting means having sorting compartments located at said output and being connected to said control means for sorting said items delivered to said output into said sorting compartments.

8. A process for orienting sheet-like items from an initial orientation into a predetermined orientation with a turning device comprising a service station rotatable about an axis of rotation into first and second rest positions, said service station comprising a conveying path having first and second openings, a belt conveyor, a switching station, and a conveying system comprising first and second arms connected to an output, said process comprising determining the initial orientation of said items, conveying said items from said switching station in a predetermined manner to said service station through one of said first and second openings, causing said service station to assume one of said first or second rest positions depending on the initial orientation of said items, and conveying said items through one of said first and second openings from said service station to on of said first and second arms so that said items are delivered to said output in a predetermined orientation.

9. The process of claim 8 wherein said conveying path of said service station is operable in a forward and reverse direction, and said process further comprises operating said conveying path in said forward or said reverse direction to convey said items through one of said first and second openings depending on the initial orientation of said items.

10. The process of claim 8 wherein said items are conveyed to said service station through said first or second opening depending on the initial orientation of said items so that the direction of movement of the conveying path need not be changed.

11. A turning device for orienting sheet-like items, comprising an input for receiving said sheet-like items, an output for discharging said items in a predetermined orientation, a service station rotatable about a axis of rotation into first and second rest positions separated by 180° of arc, said service station including a first conveyor path terminating in first and second openings through which said service station receives and discharges said items, and reversible drive means associated with said first conveyor path for driving said items on said first conveyor path in a forward or a reverse direction, a second conveyor path transporting said items from said input to said first and second openings of said first conveyor path in said service station, a third conveyor path receiving said items discharged from said first and second openings and delivering them to said output, and control means connected to said service station for controlling the rotation of said service station and the direction of movement of said items on said first conveyor path so that items that are delivered to said service station in a random orientation are reoriented and delivered to said output in any one of four predetermined orientations.

12. The turning device of claim 11 further comprising testing means connected to said control means for determining the initial orientation of said items.

13. The turning device of claim 12 wherein said second conveyor path comprises first and second bifurcations terminating at positions located in registration with said first and second openings of said first conveyor path, and said turning device further comprises switching station means connected to said control means and disposed along said second conveyor path for directing said items along said first or second bifurcation for delivery of said items to said first o second opening of said first conveyor path.

14. The turning device of claim 13 wherein said third conveyor path comprises first and second arms connected to said first and second bifurcations, said first and second arms receiving said items from said first and second bifurcations after they have been discharged from said service station and delivering said items to said output.

15. The turning device of claim 14 wherein said first and second bifurcations terminate at positions located in registration with said first and second openings respectively when said service station is in said first rest position, and said first and second bifurcations terminate at positions located in registration with said second and first openings respectively when said service station is in said second rest position.

16. The turning device of claim 15 wherein said service station is disposed between said first and second bifurcations, said axis of rotation traverses said first and second openings and constitutes a longitudinal axis of symmetry for said conveying path at least in the area of said first and second openings, and said service station further comprises means for delivering said items from each of said openings to the same bifurcation when said service station is in both said first and second rest positions.

* * * * *

UNITED STATES PATENT AND TRADEMARK OFFICE

CERTIFICATE OF CORRECTION

PATENT NO. : 4,993,556

DATED : February 19, 1991

INVENTOR(S) : André Gerlier

It is certified that error appears in the above-identified patent and that said Letters Patent is hereby corrected as shown below:

On the title page, item [75] the name of the first name of the inventor should read instead:

-- André -- so that the entire line will read:

-- [75] Inventor: André Gerlier, Sciez, France --.

Signed and Sealed this

Twenty-first Day of July, 1992

*Attest:*

DOUGLAS B. COMER

*Attesting Officer*

*Acting Commissioner of Patents and Trademarks*